United States Patent [19]

Ludder

[11] 4,044,484

[45] Aug. 30, 1977

[54] LONG-SKIRTED PAPER AND PLASTIC LID FOR FOOD CONTAINERS AND THE LIKE

[75] Inventor: Rodney E. Ludder, Severna Park, Md.

[73] Assignee: Maryland Cup Corporation, Owings Mills, Md.

[21] Appl. No.: 712,355

[22] Filed: Aug. 6, 1976

[51] Int. Cl.[2] ..... G09F 3/00

[52] U.S. Cl. ..... 40/306; 229/5.8

[58] Field of Search ..... 40/306, 307, 311, 312; 215/230; 229/5.8, 43

[56] References Cited

U.S. PATENT DOCUMENTS

| | | | |
|---|---|---|---|
| 745,227 | 11/1903 | Myers | 40/307 |
| 2,020,343 | 11/1935 | Willing | 40/307 X |
| 2,121,041 | 6/1938 | Morgan | 215/230 X |
| 2,644,259 | 7/1953 | Beadle | 40/312 |
| 3,346,170 | 10/1967 | Carter | 229/43 |

*Primary Examiner*—Louis G. Mancene
*Assistant Examiner*—Wenceslao J. Contreras
*Attorney, Agent, or Firm*—Birch, Stewart, Kolasch & Birch

[57] ABSTRACT

A two-piece long-skirted lid for ice cream containers and the like is provided in which a transparent plastic shell having a raised central web for spanning a container mouth is provided with a dependent sealing skirt defining an annular trough. A printed paper disk is coterminate with the raised web and includes dependent peripheral tabs which fit into the trough and are visible through the skirt. An inturned top curl around the top of the outer wall of the skirt holds the paper and plastic assembled without adhesive and precludes contact of the paper with the container contents.

10 Claims, 7 Drawing Figures

LONG-SKIRTED PAPER AND PLASTIC LID FOR FOOD CONTAINERS AND THE LIKE

FIELD OF THE INVENTION

This invention relates to lids for ice cream containers and the like and more particularly to a long-skirted lid for such containers in which a printed paper disk is integrally combined with a vacuum formed plastic shell.

BACKGROUND OF THE INVENTION

Two piece paper lids for ice cream cartons basically comprise a skirt formed from a spiral wound tube or the like and a circular disk which is fitted into and crimped together with the paper skirt.

Because of the nature of ice cream products and other food products and the presence of moisture and wide temperature variations, such problems as separation of the disk from the skirt of the lid and sticking of the disk to the ice cream in the container are quite common. Furthermore, since both the skirt and the central disks must be printed in separate operations and with different stock, problems with registry of the printing of the skirt and color variations between the skirt and the disks are also quite common. Furthermore, the composite structure necessarily is subject to warpage and other undesireable effects.

It is an object of the present invention to provide a new and novel two piece paper and plastic long-skirted lid for ice cream and food containers and the like.

It is another object of the present invention to provide a paper and plastic long-skirted lid in which the paper portion thereof comprises a printed disk with tabs thereon that fit within a vacuum formed plastic shell such that the printing on the disk and its tabs are visible through the shell or along the top thereof to preclude the need for printing on the skirt of the lid.

Yet another object of the present invention is to provide a paper and plastic long-skirted lid for ice cream containers and the like which provide a maximum of space for printing and other indicia thereon and precludes contact between the food product and the paper portion of the lid.

These and other objects of the present invention will become more fully apparent with reference to the following specification and drawings which relate to a preferred embodiment of the present invention.

SUMMARY OF THE INVENTION

The two piece paper and plastic lid of the present invention includes a flat paper disk which is stamped out such that folding tabs around the periphery thereof will assume a cylindrical configuration closed at one end by the central web of the disk.

The plastic portion of the lid comprises a clear plastic shell having a raised central web portion surrounded by an annular trough portion which is dimensioned to receive the entire vertical extent of the down-folded tabs on the disk portion and the raised central web portion is dimensioned to be coterminate with the central web of the printed paper disk. The external boundary of the plastic shell includes a raised upstanding annular skirt or vertical flange portion extending above the central plastic web and the upper extremity of the annular trough to provide a crimpable portion in the plastic shell.

To assemble the composite lid, the peripheral tabs on the paper disk are folded downward in a cylindrical wall configuration and inserted into the dependent annular trough and the clear plastic shell. Because of the respectively coterminate dimensions of the central web of the plastic shell and the center portion of the printed paper disk, the tabs and the printing thereon fill the annular trough and are externally visible through the plastic shell and the paper disk is juxtaposed with the central plastic web. In this position, the raised annular flange is top curled inwardly by a suitable die member such that a top curl or roll crimp of plastic material is peripherally engaged with the entire folded edge portion of the paper disk to thereby maintain the latter securely integrated with the plastic shell.

Figure 5:
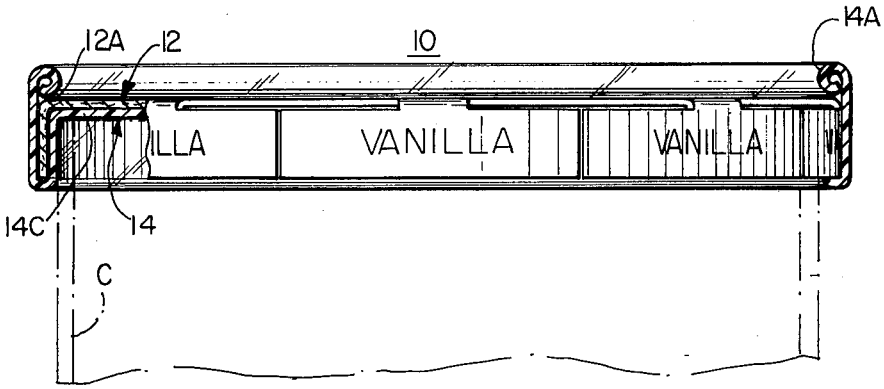
Figure 4A:
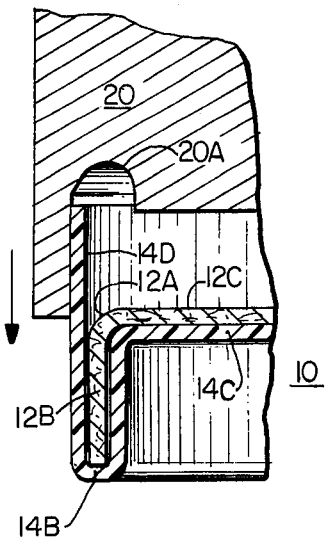
Figure 4B:
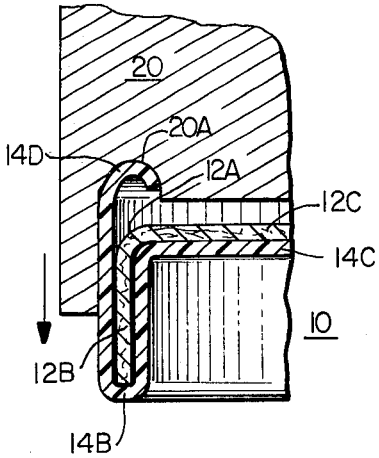
Figure 4C:
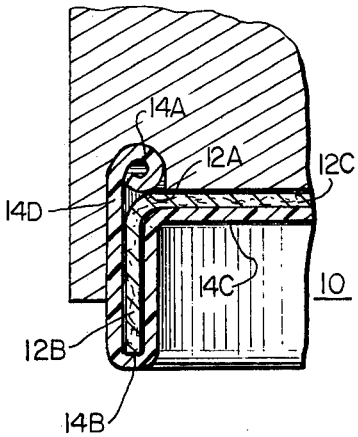

FIGS. 4A, 4B, and 4C are progressive illustrations of a crimping operation to form the plastic shell of the present invention into peripheral juxtaposition with the printed paper disk of the present invention; and FIG. 5 is a fully assembled finished lid of the present invention illustrated in partial cross section on the top portion of a container.

DETAILED DESCRIPTION OF THE DRAWINGS

Referring in detail to the drawings and with particular reference to FIGS. 1, 2, 3, and 5, the lid 10 of the present invention is shown as comprising a printed paper disk 12 and a thermoformed clear plastic shell 14.

The fully assembled lid 10 of the present invention is shown in FIG. 5 in which the plastic shell 14 has been roll crimped at 14A downwardly and inwardly into engagement with the peripheral edge 12A of the paper disk 12.

Figure 1:
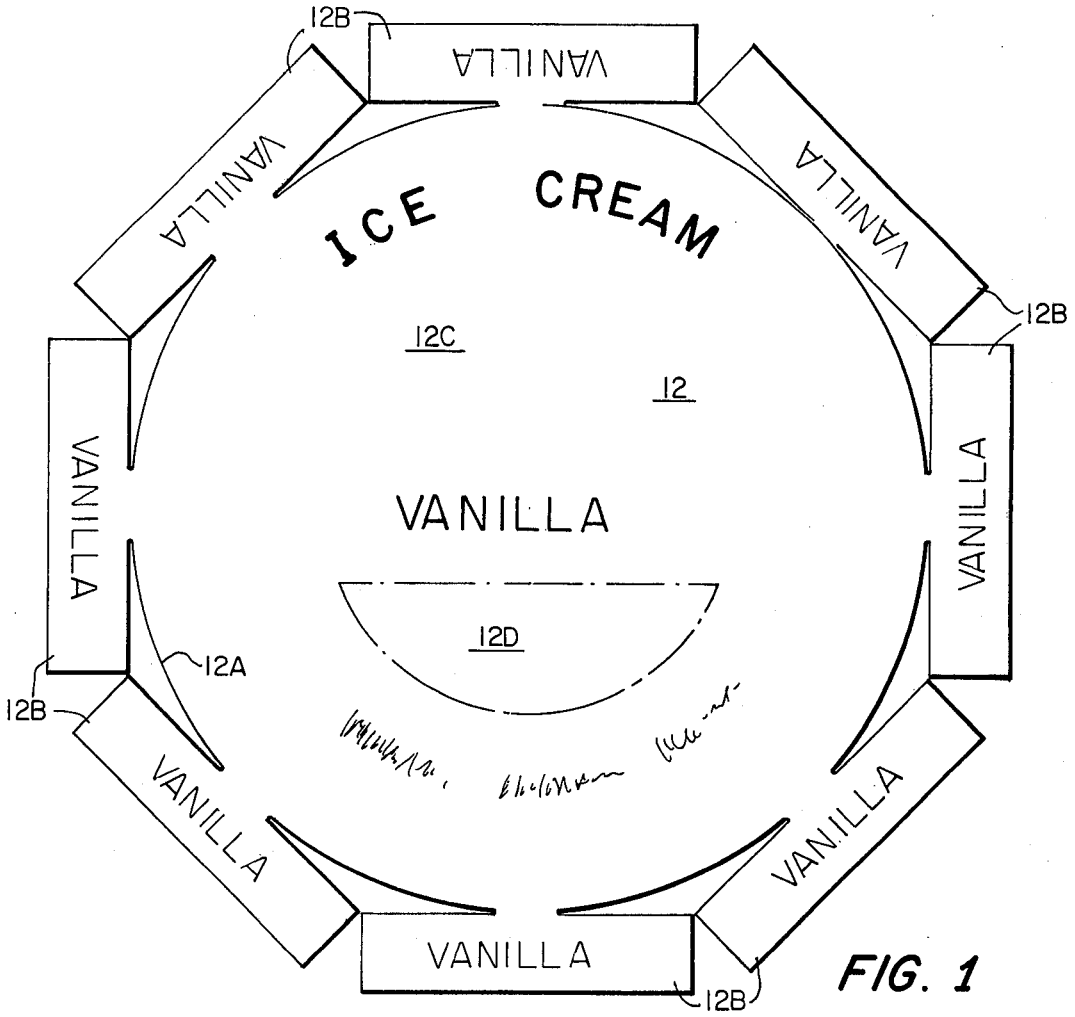
FIG. 1 is a top plan view of a printed paper disk of a preferred embodiment of the present invention.

The peripheral edge 12A is best illustrated in the top plan view of FIG. 1 in which the disk 12 is defined by a basically circular peripheral edge 12A outboard of which are a plurality of printed tabs 12B which in the present embodiment are shown as illustrating that the flavor of the ice cream or food product contained within the container bearing the lid 10 is VANILLA.

The central web 12c of the disc 12 is either completely opaque or cut out providing a transparent window 12D as shown in phantom lines and FIG. 1.

The lid is assembled by bending down the tabs 12B about the peripheral edge 12A such that the side extremities of the tabs 12B are parallel and immediately adjacent one another in the provision of a cylindrical skirt or the like.

Figure 2:
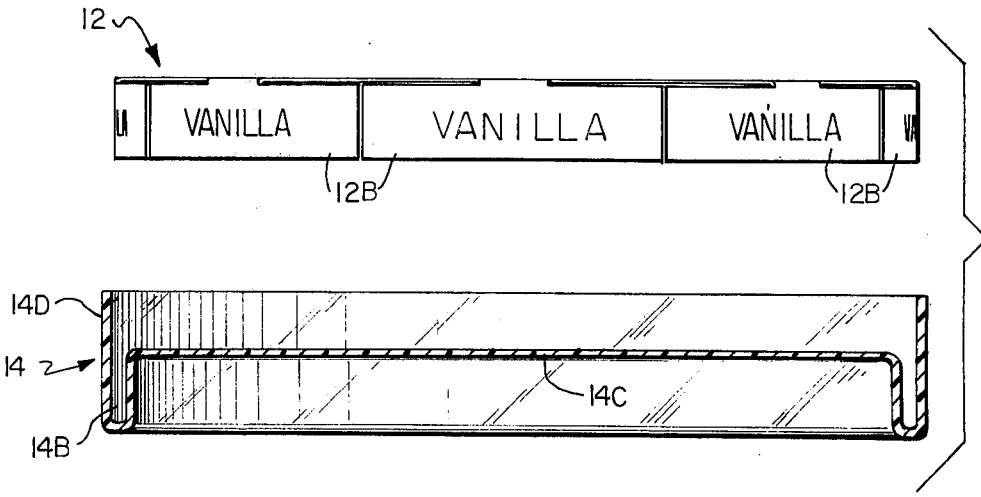
FIG. 2 is an exploded view of the printed paper disk of FIG. 1 folded and about to be placed into a clear plastic shell of the present invention.
Figure 3:
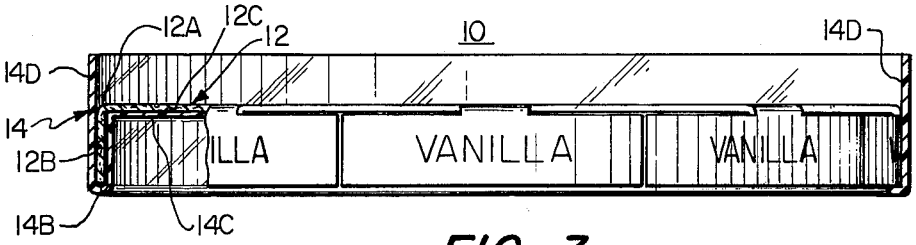
FIG. 3 is a completed assembly of the lid of FIG. 2 in partial cross section.

In the configuration thus formed, as shown in FIG. 2, the disk 12 and the tabs 12B dependent therefrom are so shaped as to be received in an annular trough 14B formed about the periphery of the plastic outer shell 14 of the lid 10. The trough 14B depends from a raised central web portion 14C which is substantially coextensive with the central web portion 12C of the printed disc 12 and adapted to be juxtaposed with the central web 12C when the tabs 12B are received within the annular trough 14B as clearly shown in FIG. 3.

Upstanding from the outer extremity of the annular trough 14B in the plastic shell 14 is an outer wall or vertical member 14D which extends upwardly above the surface of the plastic web 14C and the central web 12C of the paper disc 12 to provide a crimpable edge portion for forming the roll crimp 14A illustrated in FIG. 5.

Referring specifically to FIGS. 4A, 4B, and 4C, the upstanding annular wall 14D is schematically illustrated as being constrained by a die member 20 having a die cavity 20A shaped to produce the inwardly directed top curl 14A.

FIG. 4A, for example, illustrates the die 20 and the cavity 20A therein descending onto the assembled components of the lid 10 such that as illustrated in FIG. 4B, the die cavity 20A has begun to curl the upstanding outer wall portion 14D of the plastic shell 14 inwardly and downwardly upon itself until, in the position shown in FIG. 4C the wall portion 14D is transformed into an inwardly directed top curl 14A which is juxtaposed with the peripheral edge 12A of the printed disk 12 of the lid 10.

As can be seen from the foregoing description and drawings, the finished lid 10 of FIG. 5 provides a plastic web 14C across the entire internal span of the plastic shell 14 and it is this plastic web 14C which overlies food product in a container associated with the lid 10. No part of the paper disc 12 (including the tabs 12B thereof) comes into contact or engagement with food products or other contents of the container C.

Accordingly, even if food products such as ice cream should tend to adhear to the plastic web 14C there could be no separation of the printed disc 12 from the lid 10 because it is fully contained within the plastic shell 14C by the inwardly directed roll crimp 14A.

What is claimed is:

1. A two-piece lid for containers comprising:

a plastic shell having a first central web portion and an annular skirt dependent from the periphery of said web portion, said annular skirt having inner and outer wall portions defining an annular trough therebetween and said outer wall having an upper portion extending above said web portion; and an indicia bearing disc member having a second central web portion in substantially coextensive juxtaposition with said first central web portion and peripheral tab means thereon extending downwardly into said annular trough;

said upper portion of said outer wall of said skirt comprising an inwardly facing annular top curl juxtaposed with said second web portion of said disc member about the periphery of said first central web portion.

2. The invention defined in claim 1, wherein said plastic shell is formed of transparent plastic; and wherein said tabs include indicia thereon visible through said outer wall of said annular trough.

3. The invention defined in claim 2, wherein said plastic shell is formed of transparent plastic; and wherein said tabs include indicia thereon visible through said outer wall of said annular trough.

4. The invention defined in claim 1, wherein said first and second central web portions comprise internal and external surfaces of said lid, respectively.

5. The invention defined in claim 4, wherein said plastic shell is formed of transparent plastic; and wherein said tabs include indicia thereon visible through said outer wall of said annular trough.

6. The invention defined in claim 1, wherein said first central web portion and said internal wall of said annular skirt comprise means for retaining said lid on a container.

7. The invention defined in claim 6, wherein said first and second central web portions comprise internal and external surfaces of said lid, respectively.

8. The invention defined in claim 7, wherein said plastic shell is formed of transparent plastic; and wherein said tabs include indicia thereon visible through said outer wall of said annular trough.

9. A container lid structure for closing and sealing containers of frozen and moist food products and the like comprising:

a flexible plastic shell having a central web portion and a dependent annular skirt for internally and removably receiving the open end of a conformally shaped container;

an annular trough defined in said skirt;

an indicia bearing disc of flexible sheet material having dependent peripheral portions contained within said annular trough and a central portion overlying and substantially coterminous with said central web portion; and annular bead means formed in said plastic shell about the periphery thereof overlying said annular trough and the periphery of said portion of said disc to maintain said disc and said shell in an integral lid structure;

said plastic shell acting to shield said disc from the contents of an associated container.

10. A container lid structure for closing and sealing containers of frozen and moist food products and the like comprising:

a flexible plastic shell of transparent material having a central web portion and a dependent annular skirt for internally and removable receiving the open end of a conformally shaped container;

an annular trough defined in said skirt;

an indicia bearing disc of flexible sheet material having dependent peripheral portions contained within said annular trough and a central portion overlying and substantially coterminous with said central web portion; and annular bead means formed in said plastic shell about the periphery thereof overlying said annular trough and the periphery of said central portion of said disc to maintain said disc and said shell in an integral lid structure;

said plastic shell acting to shield said disc from the contents of an associated container; and said central portion of said disc including a window means therein to provide a view of the contents of an associated container therethrough.

* * * * *